US007772944B2

(12) United States Patent
Kurasawa et al.

(10) Patent No.: US 7,772,944 B2
(45) Date of Patent: Aug. 10, 2010

(54) STARTER HAVING MINIMIZED ELECTROMAGNETIC SWITCH

(75) Inventors: Tadahiro Kurasawa, Chita-gun (JP); Kazuhiro Andoh, Okazaki (JP); Yamato Utsunomiya, Kariya (JP)

(73) Assignee: Denso Corporation, Kariya (JP)

( * ) Notice: Subject to any disclaimer, the term of this patent is extended or adjusted under 35 U.S.C. 154(b) by 133 days.

(21) Appl. No.: 11/822,952

(22) Filed: Jul. 11, 2007

(65) Prior Publication Data

US 2008/0024253 A1 Jan. 31, 2008

(30) Foreign Application Priority Data

Jul. 26, 2006 (JP) ..... 2006-203057

(51) Int. Cl.
*H01H 67/02* (2006.01)

(52) U.S. Cl. ..... 335/126; 335/131

(58) Field of Classification Search ..... 335/131, 335/126

See application file for complete search history.

(56) References Cited

U.S. PATENT DOCUMENTS 4,213,108 A * 7/1980 Gross ..... 335/131
5,245,304 A * 9/1993 Zenmei ..... 335/126
5,245,881 A * 9/1993 Rometsch ..... 74/7 A
5,494,010 A 2/1996 Niimi et al.
5,644,171 A 7/1997 Yumiyama et al.
5,656,981 A * 8/1997 Niimi et al. ..... 335/126
5,679,935 A * 10/1997 Baba et al. ..... 200/17 R
5,939,960 A * 8/1999 Godel et al. ..... 335/126
6,404,310 B1 * 6/2002 Ando et al. ..... 335/133
6,930,576 B2 * 8/2005 Usami ..... 335/126
7,034,643 B1 * 4/2006 Kusumoto et al. ..... 335/126

(Continued)

FOREIGN PATENT DOCUMENTS

CN 1464943 A 12/2003

(Continued)

OTHER PUBLICATIONS

First Office Action issued by the State Intellectual Property Office (SIPO); Application No. 200710136702.02; Jul. 17, 2009.

(Continued)

*Primary Examiner*—Elvin G Enad
*Assistant Examiner*—Alexander Talpalatskiy
(74) *Attorney, Agent, or Firm*—Oliff & Berridge, PLC

(57) ABSTRACT

A starter includes a motor and an electromagnetic switch disposed close to and radially outward of the motor. The switch includes a contacts cover, a terminal bolt, and a conductive metal member. The contacts cover is cup-shaped. The terminal bolt is secured in the contacts cover so as to extend in the axial direction of the motor through an end wall of the contacts cover. The metal member has a first and a second end portion. The first end portion is inserted in the contacts cover through a side wall of the contacts cover. The second end portion is located outside the contacts cover and electrically connected to the motor. The switch further includes a movable contact, a first fixed contact that is electrically connected to a power source via the terminal bolt, and a second fixed contact made up of the first end portion of the metal member.

7 Claims, 5 Drawing Sheets

U.S. PATENT DOCUMENTS

| | | | |
|---|---|---|---|
| 2005/0057046 | A1 | 3/2005 | Kitagawa et al. |

FOREIGN PATENT DOCUMENTS

| | | |
|---|---|---|
| JP | 47-2693 | 1/1972 |
| JP | 07-230751 | 8/1995 |
| JP | 08-042431 | 2/1996 |
| JP | A 2001-155609 | 6/2001 |
| JP | B2 3478211 | 10/2003 |
| JP | 2005-110484 | 4/2005 |
| WO | WO 03/006824 A1 | 1/2003 |

OTHER PUBLICATIONS

Notification of Reasons for Rejection for Japanese Patent Application No. 2006-203057, Feb. 2, 2010, with English Translation.

* cited by examiner

STARTER HAVING MINIMIZED ELECTROMAGNETIC SWITCH

CROSS-REFERENCE TO RELATED APPLICATION

This application is based on and claims priority from Japanese Patent Application No. 2006-203057, filed on Jul. 26, 2006, the content of which is hereby incorporated by reference into this application.

BACKGROUND OF THE INVENTION

1. Technical Field of the Invention

The present invention relates to a starter for starting an engine, which includes a motor and a minimized electromagnetic switch working to operate electric power supply to the motor.

2. Description of the Related Art

Conventionally, a starter for starting an engine generally includes a motor and an electromagnetic switch that is disposed close to and radially outward of the motor and works to operate main contacts of a motor circuit.

More specifically, the electromagnetic switch includes a solenoid, a pair of fixed contacts that serve as the main contacts of the motor circuit, and a movable contact. The solenoid includes an electromagnetic coil and a plunger. The fixed contacts are connected to the motor circuit through a pair of terminal bolts.

When the electromagnetic coil is energized, the plunger is attracted by a magnetic attraction to move the movable contact, thereby causing the movable contact to bridge or electrically connect the fixed contacts. As a result, the motor circuit is closed to supply electric power from a battery to the motor.

On the contrary, when the electromagnetic coil is deenergized, the magnetic attraction disappears, causing the plunger and the movable contact to return to their initial positions. As a result, the fixed contacts are electrically disconnected, so that the motor circuit is opened and the electric power supply to the motor is thus interrupted.

Further, Japanese Patent No. 3478211 discloses an electromagnetic switch for a starter, in which the fixed contacts are integrally formed with the terminal bolts, respectively. One of the terminal bolts is electrically connected to the battery via a battery cable; the other is electrically connected to a lead taken out from the motor. Both the terminal bolts are fixed to a resin-made contacts cover.

However, in the above electromagnetic switch, the terminal bolts are arranged to extend in the axial direction of the motor and align with each other in the radial direction of the motor. Accordingly, it is difficult to minimize the electromagnetic switch in the radial direction of the motor.

More specifically, it is necessary to secure a sufficient insulation distance between the two terminal bolts, and thus there is a limit to closely disposing them in the radial direction. Further, it is also necessary to secure a sufficient distance between the two terminal bolts, so as to prevent an insulator that retains the movable contact from interfering with the fixed contacts when the movable contact makes contact with the fixed contacts. Therefore, it is difficult to minimize the electromagnetic switch in the radial direction of the motor, even if the other parts of the electromagnetic switch can be individually minimized.

SUMMARY OF THE INVENTION

The present invention has been made in view of the above-mentioned problems.

It is, therefore, a primary object of the present invention to provide a starter for staring an engine which has an improved structure that allows the electromagnetic switch of the starter to be minimized in the radial direction of the motor.

According to the present invention, there is provided a starter for starting an engine which includes a motor and an electromagnetic switch.

The motor is configured to generate, when supplied with electric power, torque to start an engine. The electromagnetic switch is disposed close to and radially outward of the motor. The electromagnetic switch includes a pair of first and second fixed contacts and a movable contact. The fixed contacts are electrically connected to a motor circuit for supplying electric power to the motor. The movable contact is configured to selectively connect and disconnect the fixed contacts, thereby selectively opening and closing the motor circuit.

The electromagnetic switch further includes a contacts cover, a terminal bolt, and a conductive metal member. The contacts cover is cup-shaped to have an end wall and a side wall and receives therein the fixed and movable contacts. The terminal bolt is secured in the contacts cover so as to extend in an axial direction of the motor with an end portion thereof protruding from the end wall of the contacts cover. The end portion of the terminal bolt is configured to be electrically connected to a power source. The metal member has a first and a second end portion. The first end portion is inserted in the contacts cover through the side wall of the contacts cover. The second end portion is located outside the contacts cover and electrically connected to the motor. The first fixed contact of the electromagnetic switch is electrically connected to the terminal bolt. The second fixed contact of the electromagnetic switch is made up of the first end portion of the metal member.

With the above configuration, the contacts cover has only the single terminal bolt for connecting the first fixed contact to the power source, without another one for connecting the second fixed contact to the motor as in the above-mentioned conventional starter. Further, since the terminal bolt extends through the end wall of the contacts cover whereas the metal member extends through the side wall of the same, a sufficient insulation distance between the terminal bolt and the metal member can be definitely secured. Consequently, the diameter of the contacts cover and thus the dimension of the whole electromagnetic switch in the radial direction of the motor can be minimized.

BRIEF DESCRIPTION OF THE DRAWINGS

The present invention will be understood more fully from the detailed description given hereinafter and from the accompanying drawings of the preferred embodiments of the invention, which, however, should not be taken to limit the invention to the specific embodiments but are for the purpose of explanation and understanding only.

In the accompanying drawings.

DESCRIPTION OF THE PREFERRED EMBODIMENTS

Figure 1:
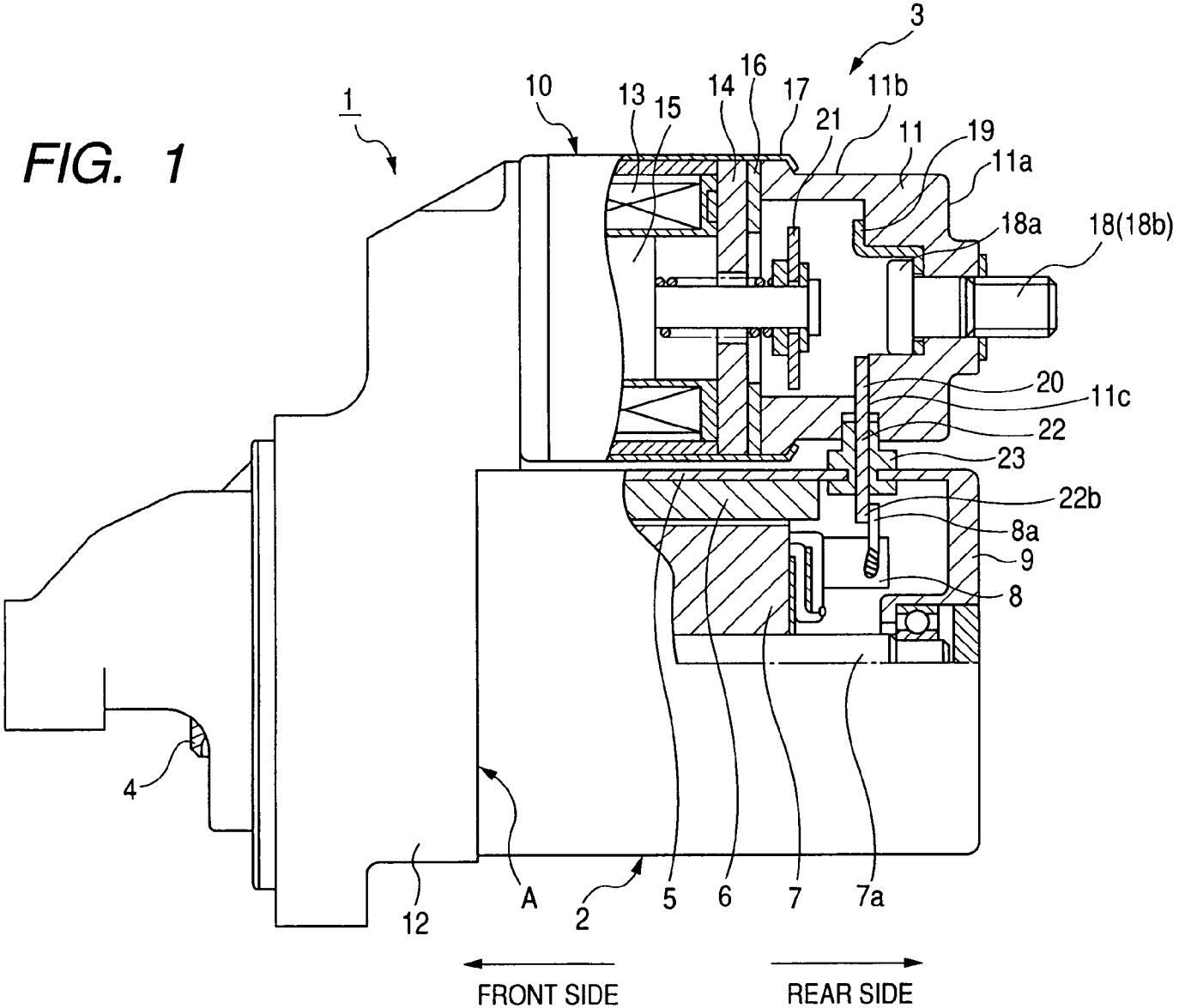
FIG. 1 is a partially cross-sectional side view showing the overall structure of a starter according to the first embodiment of the present invention.

The preferred embodiments of the present invention will be described hereinafter with reference to FIGS. 1-5.

It should be noted that, for the sake of clarity and understanding, identical components having identical functions in different embodiments of the invention have been marked, where possible, with the same reference numerals in each of the figures.

First Embodiment

FIG. 1 shows the overall structure of a starter 1 according to the first embodiment of the invention. The starter 1 is designed to start an internal combustion engine of an automobile.

As shown in FIG. 1, the starter 1 includes a motor 2 working to generate torque, an electromagnetic switch 3 working to selectively open and close a circuit for supplying electric power to the motor 2 (to be referred to as motor circuit hereinafter), a pinion 4 configured to be rotated by the torque generated by the motor 2. The starter 2 starts the engine in such a manner well known in the art as to bring the pinion gear 4 into mesh with a ring gear (not shown) of the engine and thereby transmit the torque generated by the motor 2 from the pinion gear 4 to the ring gear.

The motor 2 includes a cylindrical yoke 5 for forming a magnetic circuit, permanent magnets 6 arranged on the inner periphery of the yoke 5 to create a magnetic field, an armature 7 disposed on the inner periphery of the permanent magnets 6, brushes 8 for supplying electric power from a battery (not shown) to the armature 7, and an end frame 9 that covers the rear open end of the yoke 5.

The electromagnetic switch 3 includes a solenoid 10 and a contacts cover 11 for receiving therein main contacts of the motor circuit. The electromagnetic switch 3 works to selectively connect and disconnect the main contacts; it also works to shift the pinion gear 4 forward via a shift level (not shown) to mesh with the ring gear of the engine.

Figure 2:
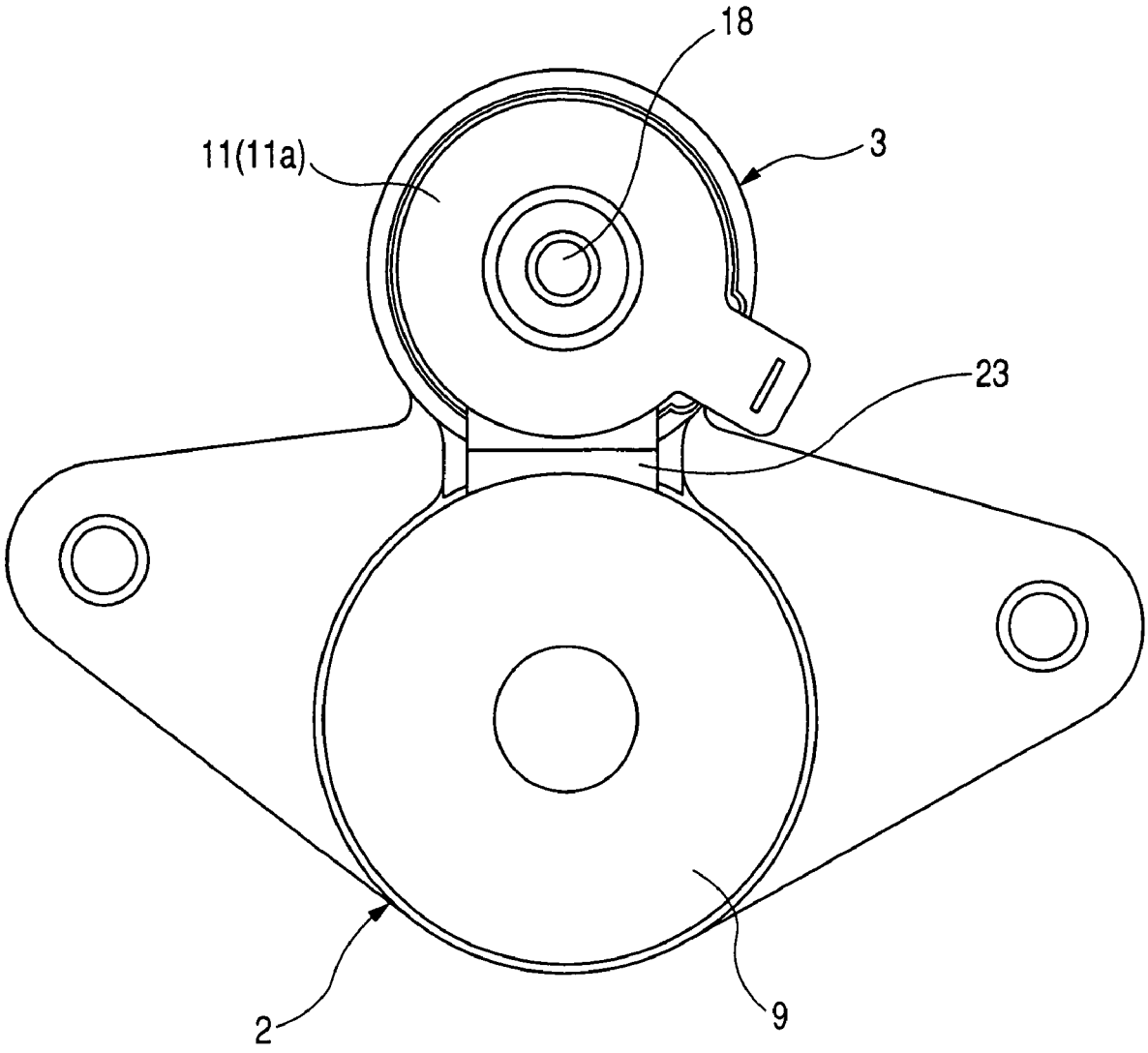
FIG. 2 is a rear end view of the starter of FIG. 1.

Referring to FIGS. 1-2, the electromagnetic switch 3 is disposed close to and radially outward of the motor 2 with the axis thereof parallel to an armature shaft 7*a* of the motor 2. The electromagnetic switch 3 is mounted, together with the motor 2, to a front housing 12 of the starter 1.

The solenoid 10 includes a cylindrical electromagnetic coil 13, a fixed iron core 14 to be magnetized upon energizing the electromagnetic coil 13, a plunger 15 to move within the electromagnetic coil 13, and a case 17 receiving therein all the other parts of the solenoid 10.

The contacts cover 11 is made of a resin and has the shape of a cylindrical cup with an end wall 11*a* and a side wall 11*b*. The contacts cover 11 is fixed to the rear end of the case 17 by crimping, with a packing 16 interposed between the front end of contacts cover 11 and the rear end of the fixed iron core 14.

The electromagnetic switch 3 further includes a pair of fixed contacts 19 and 20, which serve as the main contacts of the motor circuit, and a movable contact 21 working to selectively connect and disconnect the fixed contacts 19 and 20. The fixed contact 19 is electrically connected, as a B (Battery) fixed contact, to the battery via a terminal bolt 18. On the other hand, the fixed contact 20 is electrically connected, as an M (Motor) fixed contact, directly to the motor 2 without a terminal bolt intervening therebetween. The movable contact 21 works to selectively connect and disconnect the fixed contacts 19 and 20, thereby selectively closing and opening the motor circuit.

The terminal bolt 18 is insert-molded in the contacts cover 11 so that it extends in the axial direction of the motor 2 through a central portion of the end wall 11*a* of the circuits cover 11 with a rear end portion 18*b* thereof protruding from the end wall 11*a*. To the rear end portion 18*b* of the terminal bolt 18, a battery cable (not shown) drawn from the battery is connected and fixed by fastening a nut (not shown) onto the rear end portion 18*b*.

The B fixed contact 19 is sandwiched, within the contacts cover 11, between the a head portion 18*a* of the terminal bolt 18 and the end wall 11*a* of the contacts cover 11, so that it is electrically connected to the terminal bolt 18.

The M fixed contact 20 is made up of a conductive metal plate 22 (e.g., a copper plate). More specifically, the metal plate 22 is retained by a rubber grommet 23 that is sandwiched between the rear end of the yoke 5 and the front end of the end frame 9. The metal plate 22 has a first end portion 20 that protrudes from the grommet 23 and is inserted in the contacts cover 11 through the side wall 11*b* to form the M fixed contact 20. The metal plate 22 also has a second end portion 22*b* that protrudes from the grommet 23 and is inserted in the motor 2. To the second end portion 22*b*, there is electrically connected a pigtail 8*a* of a positive brush 8 that is arranged on the positive side (i.e., the non-ground side) of the armature 7.

The grommet 23 hermetically seals between the metal plate 22 and the yoke 5 and the end frame 9 of the motor 2. The grommet 23 also hermetically seals between the metal plate 22 and the contacts cover 11 of the electromagnetic switch 3. More specifically, referring to FIG. 3, the grommet 23 includes a sealing portion 23*a* that hermetically seals between metal plate 22 and the contacts cover 11 of the electromagnetic switch 3.

Figure 3:
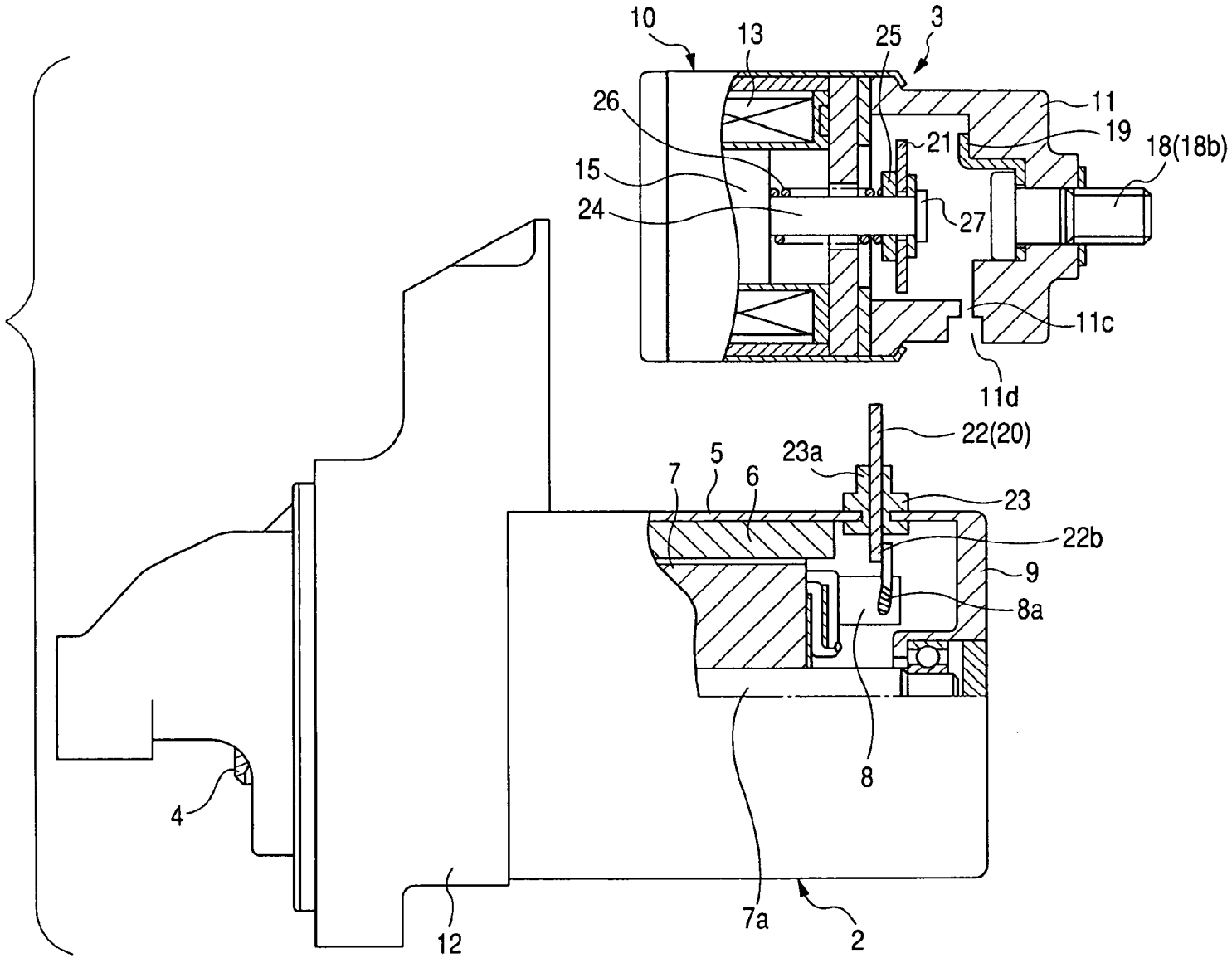
FIG. 3 is an exploded view of the starter of FIG. 1.

On the other hand, as shown in FIG. 3, in the side wall 11*b* of the contacts cover 11, there are formed an insert hole 11*c*, through which the first end portion 20 of the metal plate 22 is inserted in the contacts cover 11, and a recess 11*d* in which the sealing portion 23*a* of the grommet 23 is elastically fit to hermetically seal between the metal plate 22 and the contacts cover 11.

Referring back to FIG. 1, in the present embodiment, the axial distance from a mount face A of the motor 2, which is provided for mounting the motor 2 to the front housing 12, to the metal plate 22 is made substantially equal to the axial distance from the mount face A of the motor 2 to the insert hole 11*c* of the contacts cover 11.

The movable contact 21 is, as shown in FIG. 3, slidably mounted via an insulator 25 on a rear end portion of a shaft 24 that is fixed to the plunger 15 of the solenoid 10. Further, the movable contact 21 is urged backward by a contact-pressure spring 26 and kept from being detached from the shaft 24 by a washer 27 fixed to the rear end of the shaft 24.

After having described the overall structure of the starter 1, the operation thereof will now be described.

When the electromagnetic coil 13 is energized upon turning on a starter switch (not shown), the fixed iron core 14 is magnetized to attract the plunger 15 to move backward against the spring force of a return spring (not shown). With the backward movement of the plunger 15, the shaft 24 fixed to the plunger 15 is also moved backward, thereby bringing the movable contact 21 into contacts with the fixed contacts 19 and 20. After that, the plunger 15 is further moved backward against both the spring forces of the return spring and the contact-pressure spring 26. Thus, the movable contact 21 is pressed against the fixed contacts 19 and 20 by the compressive load of the contact-pressure spring 26, thereby bridging or electrically connecting the fixed contacts 19 and 20. Consequently, the motor circuit is closed so that the motor is supplied with electric power from the battery to start the engine.

As soon as the engine has started, the electromagnetic coil 13 is deenergized upon turning off the starter switch, thus causing the magnetic attraction for the plunger 15 to disappear. Then, the plunger 15 is moved forward by the spring force of the return spring to return to the initial rest position thereof. With the forward movement of the plunger 15, the shaft 24 is also moved forward, thereby detaching the movable contact 21 from the fixed contacts 19 and 20. Consequently, the fixed contacts 19 and 20 are electrically disconnected, and thus the motor circuit is opened. As a result, the electric power supply from the battery to the motor 2 is interrupted.

The above-described starter 1 according to the present embodiment has the following advantages.

In the starter 1, the electromagnetic switch 3 is disposed close to and radially outward of the motor 2. The electromagnetic switch 3 includes the terminal bolt 18, which extends in the axial direction of the motor 2 and has the rear end portion 18*b* protruding from the rear end wall 11*a* of the contacts cover 11, and the B fixed contact 19 connected to the terminal bolt 18. The electromagnetic switch 3 also includes the conductive metal plate 22 that has the first end portion 20, which is inserted in the contacts cover 11 through the side wall 11*b* thereof to make up the M fixed contact 20, and the second end portion 22*b* inserted in the motor 2 so as to be directly connected to the pigtail 8*a* of the positive brush 8.

With the above configuration, the contacts cover 11 has only the single terminal bolt 18 for connecting the B fixed contact 19 to the battery, without another one for connecting the M fixed contact 20 to the motor 2 as in the above-mentioned conventional starter.

Further, since the terminal bolt 18 extends through the rear end wall 11*a* of the contacts cover 11 whereas the metal plate 22 extends through the side wall 11*b* of the same, a sufficient insulation distance between the terminal bolt 18 and the metal plate 22 can be definitely secured.

Consequently, the diameter of the contacts cover 11 and thus the dimension of the whole electromagnetic switch 3 in the radial direction of the motor 2 can be minimized.

Further, in the starter 1, the terminal bolt 18 is configured to extend through the central portion of the end wall 11*a* of the contacts cover 11.

With this configuration, a sufficient working space is secured around the terminal bolt 18. Consequently, it is easy to fasten the nut onto the terminal bolt 18 for connecting the battery cable to the terminal bolt 18.

Moreover, in fastening the nut onto the terminal bolt 18, the fastening force can be evenly transmitted from the circumference of the terminal bolt 18 to the contacts cover 11, thus avoiding any local concentration of stress in the contacts cover 11.

Furthermore, with the above configuration, an even surface distance is secured between the circumferences of the terminal bolt 18 and the rear end wall 11*a* of the contacts cover 11, thereby making it possible to further minimize the diameter of the contacts cover 11.

Second Embodiment

This embodiment illustrates a starter 1A which has a structure almost identical to that of the starter 1 according to the first embodiment. Accordingly, only the differences between the starters 1 and 1A will be described hereinafter.

Figure 4:
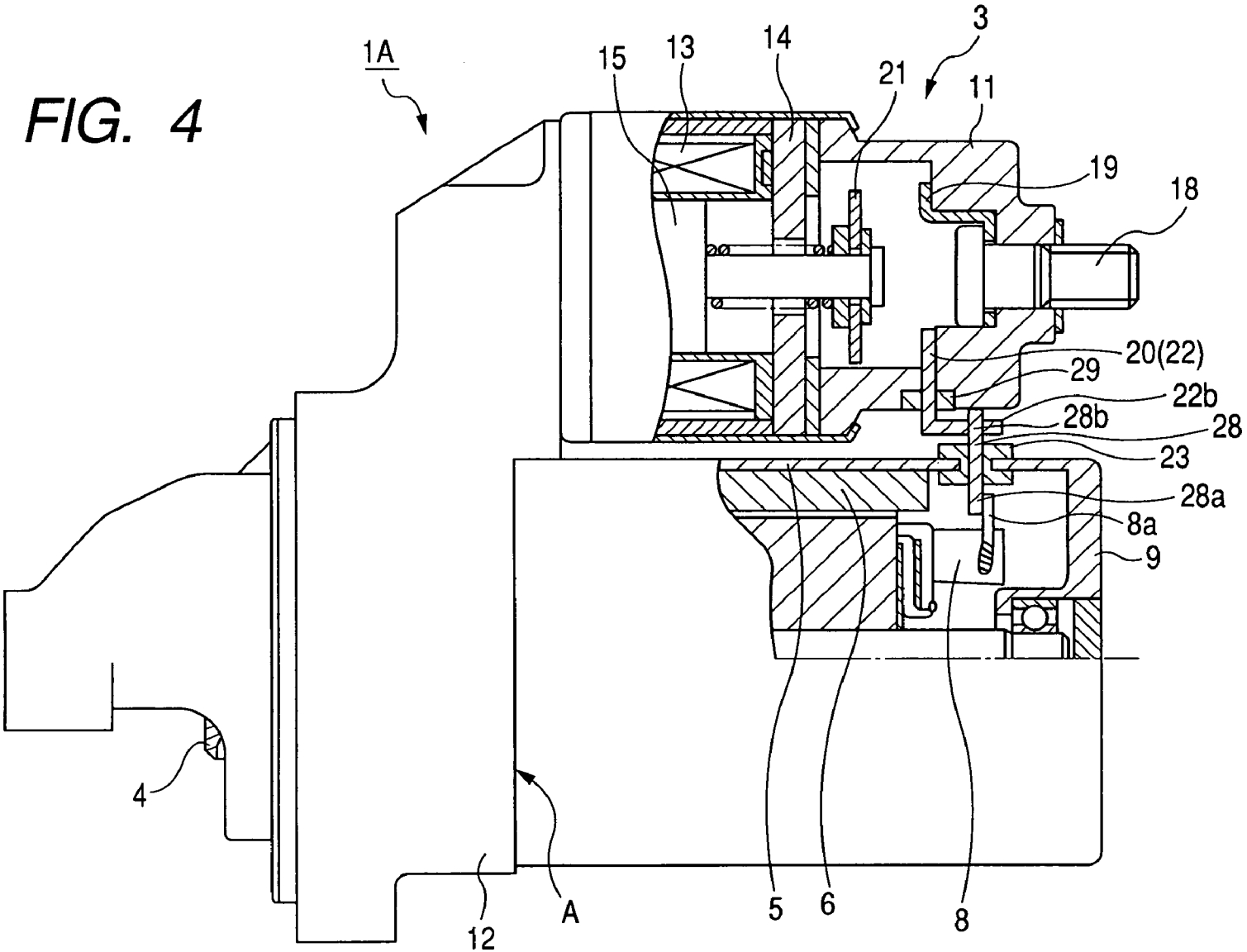
FIG. 4 is a partially cross-sectional side view showing the overall structure of a starter according to the second embodiment of the invention.

As shown in FIG. 4, the starter 1A further includes, compared to the starter 1, a connecting plate 28 that connects the metal plate 22, which makes up the M fixed contact 20, to the pigtail 8*a* of the positive brush 8.

More specifically, in the starter 1A, the first end portion of the metal plate 22 is inserted in the contacts cover 11 to form the M fixed contact 20. The second end portion 22*b* of the metal plate 22 is bent to extend in the axial direction of the motor 2, and thus is not inserted in the motor 2. In addition, a sealing member 29 is employed, instead of the grommet 23, to hermetically seal between the metal plate 22 and the contacts cover 11.

The connecting plate 28 is made of a conducive metal, such as copper, and is retained by the grommet 23. The connecting plate 28 has a first end portion 28*a*, which protrudes from the grommet 23 into the motor 2 and is directly connected to the pigtail 8*a* of the positive brush 8, and a second end portion 28*b* that protrudes from the grommet 23 out the motor 2 and is directly connected to the second end portion 22*b* of the metal plate 22.

When the axial distance from the mount face A of the motor 2 to the metal plate 22 inserted in the contacts cover 11 is different from the axial distance from the mount face A to the grommet 23 inserted in the motor 2, it is difficult to directly connect the metal plate 22 to the pigtail 8*a* of the positive brush 8 through the grommet 23.

In such cases, however, it is still possible to reliably connect the metal plate 22 to the pigtail 8*a* of the positive brush 8 through the connecting plate 28 as described above.

In addition, the metal plate 22 and the connecting plate 28 may be connected to each other by, for example, welding, soldering, or crimping.

The above-described starter 1A according to present embodiment has the same advantages as the starter 1 according to the first embodiment.

Third Embodiment

This embodiment illustrates a starter 1B which has a structure almost identical to that of the starter 1 according to the first embodiment. Accordingly, only the differences between the starters 1 and 1B will be described hereinafter.

Figure 5:
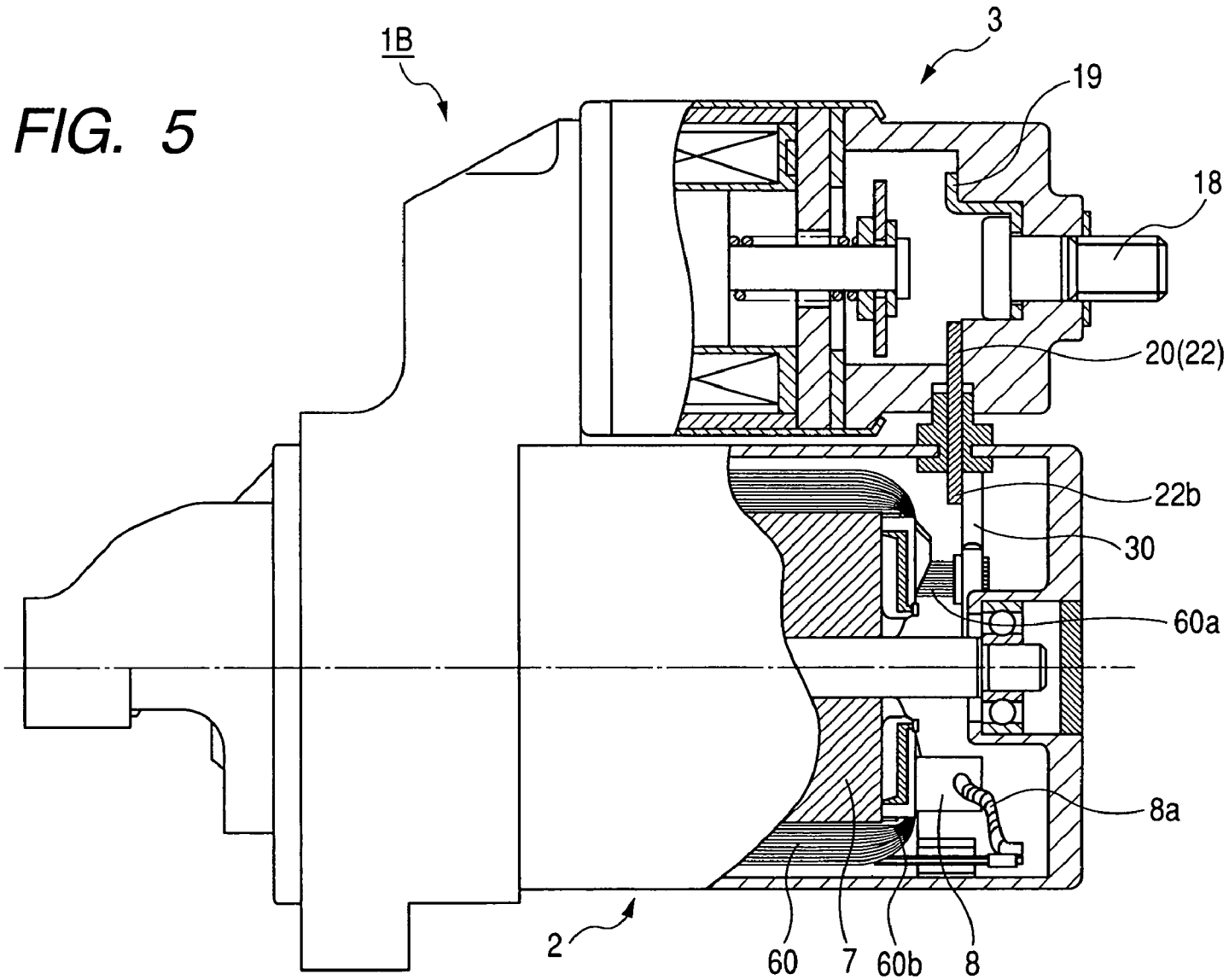
FIG. 5 is a partially cross-sectional side view showing the overall structure of a starter according to the third embodiment of the invention.

As shown in FIG. 5, the starter 1B includes a plurality of field coils 60, instead of the permanent magnets 6 as in the starter 1, to create the magnetic field.

Each of the field coils 60 has a first end 60*a* and a second end 60*b*. All the first ends 60*a* of the field coils 60 are connected to a connection bar 30 provided in the motor 2; all the second ends 60*b* of the field coils 60 are connected to the pigtail 8*a* of the positive brush 8.

Further, in the present embodiment, the second end portion 22*b* of the metal plate 22 is inserted in the motor 2 so as to be directly connected to the connection bar 30.

With the above configuration, the field coils 60 are electrically connected in series with the armature 7 of the motor 2.

The above-described starter 1B according to present embodiment has the same advantages as the starter 1 according to the first embodiment.

While the above particular embodiments of the invention have been shown and described, it will be understood by those who practice the invention and those skilled in the art that various modifications, changes, and improvements may be made to the invention without departing from the spirit of the disclosed concept.

For example, it is possible to provide a starter 1C which has a structure that is a combination of the structures of the starters 1B and 1C according to the second and third embodiments of the invention.

More specifically, though not graphically shown, the starter 1C may include a plurality of field coils 60 for creating the magnetic field. The first ends 60*a* of the field coils 60 may be connected to a connection bar 30 provided in the motor 2; the second ends 60*b* of the same may be connected to the pigtail 8*a* of the positive brush 8. Further, the second end portion 22*b* of the metal plate 22 may be located outside the motor 2. The starter 1C may further include a conductive connecting member 28. The first end portion 28*a* of the connecting member 28 may be inserted in the motor 2 so as to be directly connected to the connection bar 30; the second end portion 28*b* of the same may be located outside the motor 2 and connected to the second end portion 22*b* of the metal plate 22. The starter 1C having such a structure will have the same advantages as the starters 1-1B according to the previous embodiments.

Such modifications, changes, and improvements within the skill of the art are intended to be covered by the appended claims.

What is claimed is:

1. A starter for starting an engine, comprising:

a motor configured to generate, when supplied with electric power, torque to start an engine; and an electromagnetic switch disposed close to and radially outward of the motor, the electromagnetic switch including a pair of first and second fixed contacts and a movable contact, the fixed contacts being electrically connected to a motor circuit for supplying electric power to the motor, the movable contact being configured to selectively connect and disconnect the fixed contacts, thereby selectively opening and closing the motor circuit, wherein the electromagnetic switch further includes a contacts cover, a terminal bolt, a conductive metal member, and an elastic sealing member, the contacts cover is cup-shaped to have an end wall and a side wall and receives therein the fixed and movable contacts, the terminal bolt is secured in the contacts cover so as to extend in an axial direction of the motor with an end portion thereof protruding from the end wall of the contacts cover, the end portion of the terminal bolt being configured to be electrically connected to a power source, the metal member has a first and a second end portion, the first end portion being inserted in the contacts cover through the side wall of the contacts cover, the second end portion being located outside the contacts cover and electrically connected to the motor, the sealing member is fixed to the motor and elastically fit to an opening in the side wall of the contacts cover, thereby restricting relative movement between the motor and the contacts cover, the sealing member retains therein the metal member with the first end portion of the metal member protruding therefrom, thereby hermetically sealing the metal member and the contacts cover, the second fixed contact of the electromagnetic switch is made up of the first end portion of the metal member, the terminal bolt extends in the axial direction of the motor through a central portion of the end wall of the contacts cover, the first fixed contact of the electromagnetic switch has first and second end portions, the first end portion of the first fixed contact is electrically connected to the terminal bolt, and the second end portion of the first fixed contact is located radially outward of the terminal bolt so as to be further away from the second fixed contact than the terminal bolt and face the movable contact in the axial direction of the motor.

2. The starter as set forth in claim 1, wherein the motor includes a field working to create a magnetic field, an armature working to generate torque in the magnetic field created by the field, and brushes for supplying electric power to the armature, and wherein the second end portion of the metal member is electrically connected to a pigtail of a positive one of the brushes which is arranged on the positive side of the armature.

3. The starter as set forth in claim 2, wherein the second end portion of the metal member is inserted in the motor so as to be directly connected to the pigtail of the positive brush.

4. The starter as set forth in claim 1, wherein the motor includes a field working to create a magnetic field, an armature working to generate torque in the magnetic field created by the field, and brushes for supplying electric power to the armature, and wherein the field includes a plurality of field coils each of which has a first and a second end, the first ends of the field coils are electrically connected to a connection bar provided in the motor, the second ends of the field coils are electrically connected to a pigtail of a positive one of the brushes which is arranged on the positive side of the armature, and the second end portion of the metal member is electrically connected to the connection bar.

5. The starter as set forth in claim 4, wherein the second end portion of the metal member is inserted in the motor so as to be directly connected to the connection bar.

6. The starter as set forth in claim 1, wherein the first end portion is sandwiched in the axial direction of the motor between the terminal bolt and the end wall of the contacts cover.

7. The starter as set forth in claim 1, wherein the electromagnetic switch includes a solenoid.

* * * * *